US008572776B2

(12) United States Patent
Grubb

(10) Patent No.: US 8,572,776 B2
(45) Date of Patent: Nov. 5, 2013

(54) ROLLING FOLDOUT CABINET BED

(76) Inventor: Jeffrey A. Grubb, Yorba Linda, CA (US)

( * ) Notice: Subject to any disclaimer, the term of this patent is extended or adjusted under 35 U.S.C. 154(b) by 189 days.

(21) Appl. No.: 12/939,089

(22) Filed: Nov. 3, 2010

(65) Prior Publication Data

US 2012/0073045 A1 Mar. 29, 2012

Related U.S. Application Data

(60) Provisional application No. 61/386,434, filed on Sep. 24, 2010.

(51) Int. Cl.
*A47C 19/22* (2006.01)

(52) U.S. Cl.
USPC ..... 5/152; 5/151; 5/159.1; 5/411

(58) Field of Classification Search
USPC ..... 5/110, 111, 174, 178–180, 722, 723, 5/907, 6, 136, 149, 151, 152, 159.1, 160, 5/411, 53.1, 167, 310
See application file for complete search history.

(56) References Cited

U.S. PATENT DOCUMENTS

| | | | | | |
|---|---|---|---|---|---|
| 83,936 | A | * | 11/1868 | Crosby | 5/152 |
| 107,881 | A | * | 10/1870 | Crosby | 5/152 |
| 192,621 | A | | 7/1877 | Green | |
| 201,282 | A | | 3/1878 | Ogboen | |
| 213,001 | A | | 3/1879 | Stanton | |
| 218,678 | A | * | 8/1879 | Koskul | 5/152 |
| 261,053 | A | | 7/1882 | Shtjpe | |
| 431,825 | A | * | 7/1890 | Sundback | 5/152 |
| 4,004,305 | A | * | 1/1977 | Rubin | 5/13 |
| 4,985,945 | A | | 1/1991 | Robinson | |
| 4,985,951 | A | | 1/1991 | Lacotte et al. | |
| 5,170,519 | A | | 12/1992 | Meade | |
| 5,386,601 | A | * | 2/1995 | Kohl | 5/174 |
| 5,440,768 | A | * | 8/1995 | Danin | 5/4 |
| 5,446,932 | A | | 9/1995 | Voorhis | |
| 6,425,151 | B2 | | 7/2002 | Barnett | |
| 6,851,139 | B2 | | 2/2005 | Arason | |
| 7,013,506 | B2 | | 3/2006 | Revels | |
| 7,574,758 | B2 | | 8/2009 | Arason et al. | |
| 2008/0092290 | A1 | | 4/2008 | Cabrera | |
| 2008/0276872 | A1 | | 11/2008 | Chern | |

OTHER PUBLICATIONS www.google.com/products?hl=en&exp . . . ; Foldable Bed Google Search; Sep. 23, 2010.
absolutecomfortonsale.com/roll-away- . . . ; Riviera Roll Away Bed; Sep. 23, 2010.
absolutecomfortonsale.com/rollaway-b . . . ; Our Top of the Line Rollaway Bed Models; Sep. 23, 2010.
absolutecomfortonsale.com/hide-a-be . . . ; The Ultimate Hide-a-Bed Guest Cabinet Bed; Sep. 23, 2010.

* cited by examiner

*Primary Examiner* — Nicholas Polito
(74) *Attorney, Agent, or Firm* — Fish & Associates, PC

(57) ABSTRACT

A rolling foldout cabinet bed has two faces that fold out from a vertical to a horizontal position, thereby creating a surface that can be used for sleeping. When the cabinet is closed, a space within the cabinet stores a foldable innerspring, or other mattress. The two faces can be locked together in the folded position. During deployment, an elastic belt or other retainer and hold the folded mattress to one of the faces, and can also pull the mattress out of the interior space within the bottom of the cabinet. The cabinet also has legs for supporting the faces above the ground when in the opened configuration, and can include wheels that facilitate moving the cabinet quickly and easily moved.

7 Claims, 5 Drawing Sheets

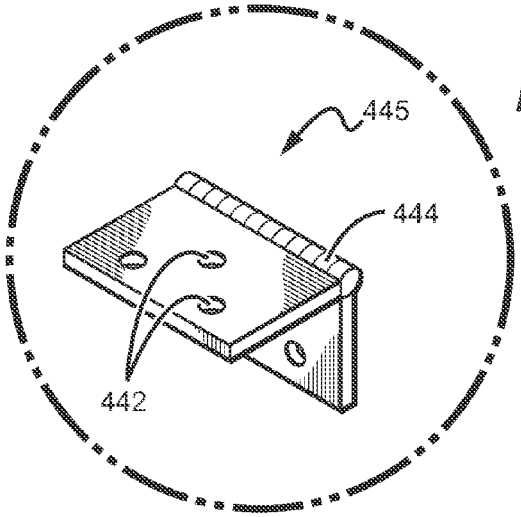
FIG. 4c
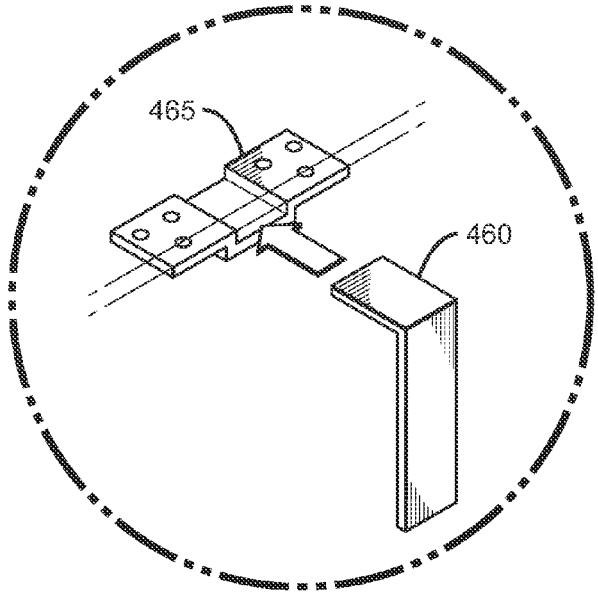
FIG. 5b
FIG. 5a
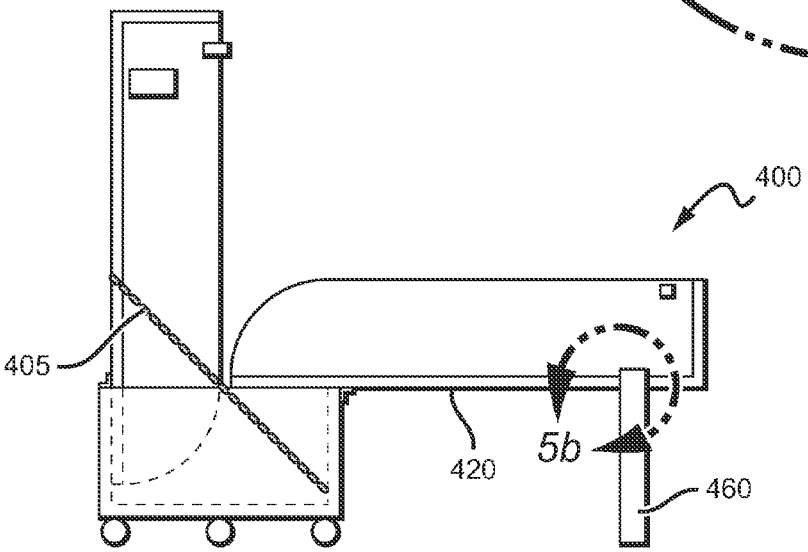

ROLLING FOLDOUT CABINET BED

This application claims the benefit of priority to U.S. Provisional Application Ser. No. 61/386,434 having a filing date of Sep. 24, 2010.

FIELD OF THE INVENTION

The field of the invention is furniture, more particularly foldout beds.

BACKGROUND

In order to conserve floor space in a room it is known to manufacture a bed that can be folded up when not in use. Such beds are sometimes designed to resemble furniture such as a cabinet, armoire, sofa, or shelf, adding to the esthetic appearance of the room. U.S. Pat. No. 5,446,932 to Voorhis, for example, teaches a wall-mounted foldable bed cabinet that can be folded up against a wall when not in use. However, mounting the bed cabinet to a wall takes time, can cause damage to the building structure, and prevents the cabinet from being mobile.

U.S. Pat. No. 218,678 to Koskul teaches a foldout bed that resembles a stand-alone cabinet when in the folded configuration. The Koskul design advantageously avoids the need to mount the bed to a wall by allowing each face of the cabinet to fold open. However, numerous problems remain in the art of such "dual-opening" cabinet beds. First, the mattress in Kodkul's bed is made in two unconnected parts, which can be uncomfortable during sleep. Second, the mechanism for unfolding the bed and supporting the mattress is complex, which adds unnecessary weight to the cabinet and introduces unnecessary points of failure.

U.S. Pat. No. 6,851,139 to Arason teaches a dual-opening foldout cabinet bed having wheels. However, numerous disadvantages are associated with this design. First, the center of gravity is too high in the folded up configuration, making the cabinet very instable, especially when pushed or moved. Second, the cabinet is too close to the ground when in the open configuration, making access to the bed difficult and undesirable for sitting and sleeping. Third, the design has many sharp edges, making the cabinet unsafe. Fourth, opening the cabinet requires much caution since the sides can fall down by themselves. Fifth, when the cabinet is in the open configuration, the mattress is not fully enclosed and can slide away from the cabinet. Sixth, an innerspring mattress is too rigid to be stored in the folded configuration within the cabinet. Finally, the foam (futon) mattress used in the cabinet bunches up when it is stored, creating dents, creases, and an irregular and uncomfortable sleeping surface. In sum, various defects remain in the art of foldout cabinet beds.

Voorhis, Koskul, Arason, and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Thus, there is still a need for a rolling foldout cabinet bed that is simple, safe, easy to use, and functions with a comfortable innerspring mattress.

SUMMARY OF THE INVENTION

The inventive subject matter provides apparatus, systems and methods in which a foldout cabinet bed has a mattress with head and foot ends, and both head and foot ends are held to one of the sides of the cabinet bed as it is being opened.

All suitable mattresses are contemplated, including inner spring and futons. The head and foot ends of the mattress can be parts of the same continuous unit, or can be split into two or more sections. Where the mattress extends as a single unit from head to foot, the mattress preferably folds in the middle, with the folded area fitting into an interior space of a base portion of the cabinet when the cabinet is in a closed configuration. Where the mattress comprises two or more sections, the abutting ends of two of the sections fit into the interior space when the cabinet is in the closed configuration.

From a method perspective, a cabinet bed has a mattress with a portion that is drawn up out of the base of the cabinet bed during deployment of the bed. That portion can either comprise a fold of a single-piece mattress, or abutting ends in a two-piece mattress. The portion that is drawn up out of the base can either be pulled or pushed out of the base. In especially preferred embodiments, a belt can be used to hold both head and foot ends of the mattress to one of the cabinet's sides, allowing the entire mattress to be pulled out of the way when opening the cabinet.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 4*c* is a perspective view of a hinge for coupling the first and second faces to the base of the foldout cabinet bed of FIG. 2.

FIG. 5*a* is a side view of a cabinet bed having a catch for holding a face of the cabinet in a substantially vertical disposition.

FIG. 5*b* is a perspective close-up view of a leg for supporting the faces when in the open configuration.

DETAILED DESCRIPTION

Figure 1:
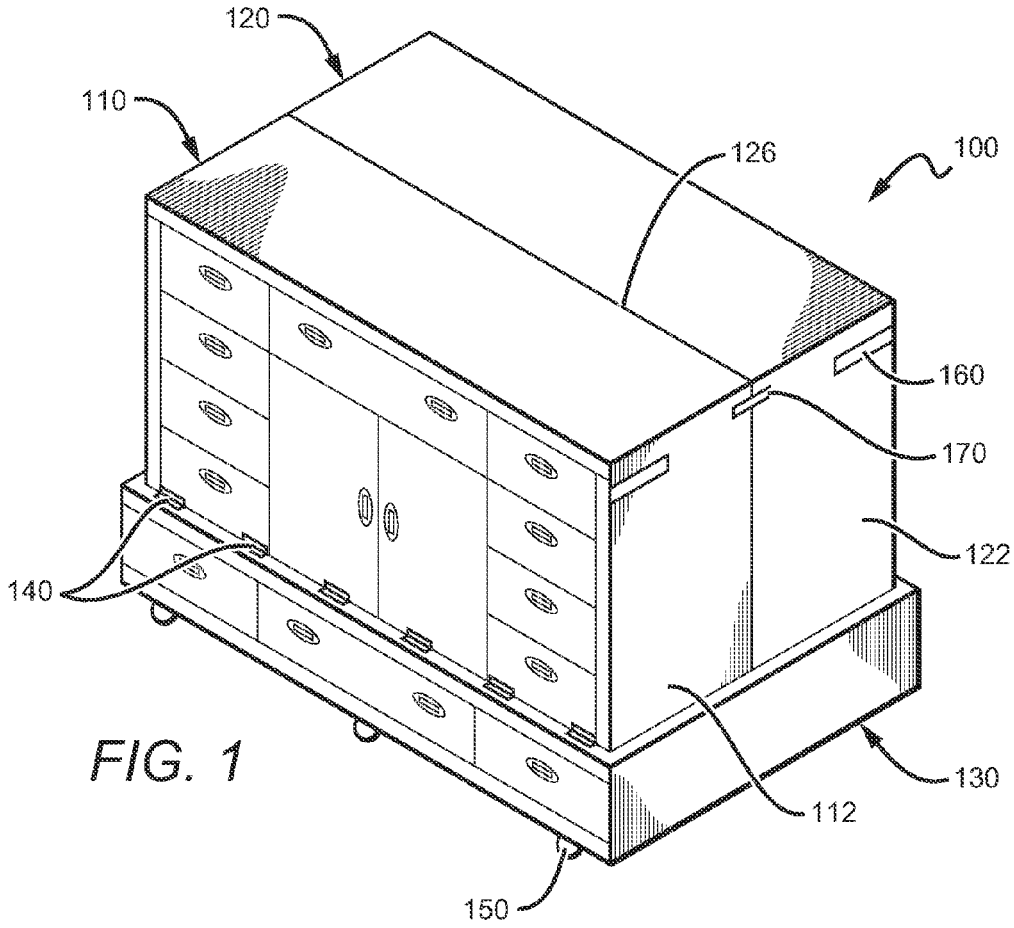
FIG. 1 is a front perspective view of one embodiment of a foldout cabinet bed in a closed configuration.

FIG. 1 shows a foldout cabinet bed 100 in a folded configuration. Cabinet bed 100 has a first face 110, second face 120, and a base 130. Each face has two flanks, face 110 having a flank 112 and face 120 having a flank 122. Face 110 and 120 meet together at an abutment 126 when in a folded configuration, and their bottom ends fit into base 130. First face 110, second face 120, and base 130 are all designed to resemble a cabinet. Base 130 has caster wheels 150 for moving cabinet bed 100. Leg 160 is one of four legs that folds out and supports the first or second face above ground while in the open configuration. Catch 170 releasably attaches face 110 to face 120, maintaining cabinet 100 in a folded configuration before release. Catch 170 could also comprise two separate catches; one that releasably attaches first face 110 to base 130 and another that releasably attaches second face 120 to base 130.

As used herein, "face" means a portion of a cabinet that defines a side (which could be front or back "sides") of the cabinet. The first and second faces preferably define a partially enclosed region suitably sized and dimensioned to house a folded mattress when the cabinet is in a folded configuration.

As used herein, the term "folded configuration" means a configuration in which lengths of first and second faces run next, and substantially parallel, to one another. "Substantially parallel" means that the acute angle of the intersection of the lengths of first and second faces is less than 10°, more preferably less than 5°, and most preferably less than 1°. As used herein, the term "open configuration" means the first and second faces of the bed have been configured to accommodate a person for sitting or lying down. Thus, as used herein the term "open configuration" includes a configuration in which one of the faces is laid horizontal, but the other face is still vertical. In a preferred open configuration, the faces are positioned such that they create a substantially horizontal surface upon which the mattress can rest, allowing a user to comfortably rest or sleep. In another open configuration the first face is parallel to the ground while the second face is at a 135° angle, providing an inclined surface for lying. One of ordinary skill in the art will appreciate that an open configuration can comprise various positions and angles of the first and second faces.

First face 110 rotates about base 130 via hinges 140, rotating from a substantially vertical disposition to a substantially horizontal disposition. Second face 120 also rotates about base 130 in a similar manner. Since both face 110 and 120 open up, cabinet 100 can be described as a "dual-opening" foldout cabinet bed. Hinges 140 are shown just above base 130 for demonstrative purposes, however hinges 140 could be hidden between first face 110 and base 130.

As used herein, the term "substantially vertical" means the overall length of an object is substantially perpendicular to the ground, within ±5°, more preferably within ±2.5°, most preferably within ±1°. "Substantially horizontal" means the overall length of an object is substantially parallel to the ground, preferably having an acute angle of intersection with the ground of less than 10°, more preferably less than 2.5°, most preferably less than 1°. Under these definitions objects can be substantially vertical or substantially horizontal even though they are not flat.

Faces 110 and 120, and base 130 are sized and dimensioned to house a folded mattress having a standard size, such as a twin, x-long twin, full, queen, king, or California king size. However, it is also contemplated that faces 110 and 120, and base 130 could be sized and dimensioned to house a "custom" sized mattress, i.e. a size not commonly sold on the market. It is also contemplated that the faces and base could be sized and dimensioned to house a mattress suitable for a pet, such as a cat or dog. While most mattresses have a general rectangular shape, one skilled in the art will appreciate that the inventive concepts taught herein could apply to a mattress having a non-rectangular shape as well. It is further contemplated that the cabinet could optionally include a space for storing things other than, and in addition to, a mattress. For example, beneath base 130 there could be a drawer for storing mattress sheets and pillows.

Caster wheels 150 allow cabinet bed 100 to be stored against a wall when not in use and later rolled away from the wall when used. In a preferred embodiment the wheels have locks for preventing the cabinet from moving. It is also contemplated that non-caster wheels or a combination of caster and non-caster wheels could be used with cabinet 100. Moveable furniture is well known and one of ordinary skill in the art will appreciate that other friction-reducing mechanisms and designs could be used with cabinet 100 in order to facilitate its movement. Unlike previous dual opening cabinet designs, the design of the cabinet bed taught herein provides a low center of gravity, allowing the cabinet to be pushed or pulled safely without the risk of falling over.

The legs preferably resemble parts of a cabinet, such as a drawer handle, and thus are "hidden" when the bed cabinet is in a folded configuration. The legs are also preferably sized such that the faces 110 and 120 are substantially horizontal, providing a flat and level surface for sleeping. However, it is also contemplated that the legs could be sized to create an inclined surface for allowing a person to lie in an inclined configuration. The length of the legs could also be adjustable, allowing the bed to lay open in a level manner, even when the ground is not level. Bubble levels or accelerometers could be integrated within the faces in order to indicate whether the faces are level when in the open configuration.

Cabinet 100 can be made of any material which can provide the structural strength required to support a person's weight. The material is preferably inexpensive and easy to manufacture. Wood is especially preferred since it is strong, inexpensive, easy to cut and shape, and can be varnished or finished to provide an attractive appearance. However, other materials such as plastic, metal, ceramic, composite, or any combination thereof, could be used to make a foldout cabinet bed. While cabinet bed 100 resembles a cabinet, cabinet 100 could also be made to resemble other pieces of furniture, for example, an armoire, or a shelf or drawer cabinet. Additionally, the design and style of cabinet 100 could resemble a particular style of furniture in order to match an interior design of a room. In one embodiment, a foldout bed cabinet intended for use in a garage resembles a tool cabinet commonly sold on the market.

Figure 2:
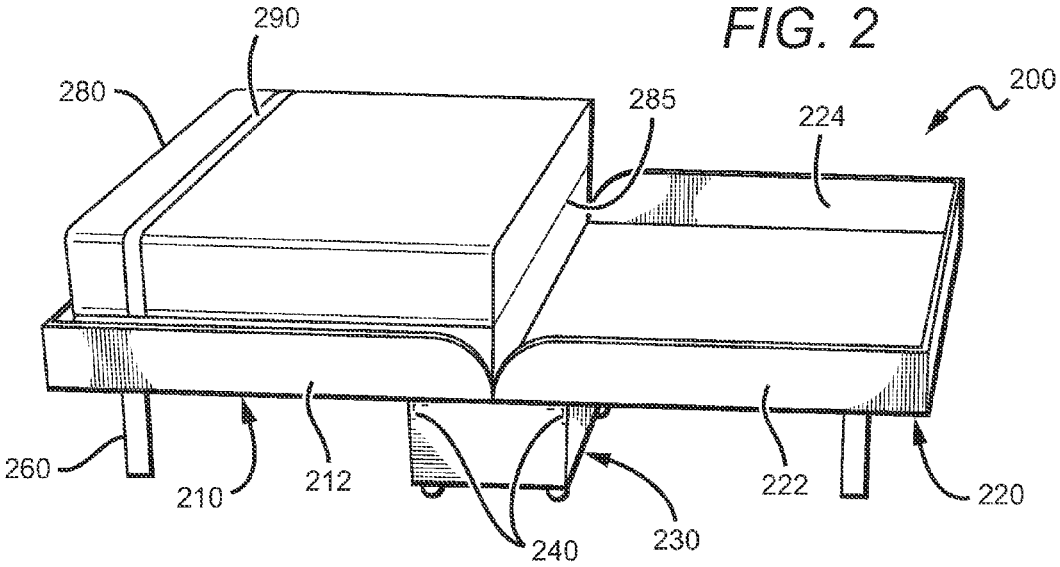
FIG. 2 is a side perspective view of one embodiment of a foldout cabinet bed in an open configuration, with the mattress held to one of the faces of the cabinet by a retainer.

FIG. 2 shows a cabinet bed 200 in an open configuration. First face 210 and second face 220 are connected to base 230 via hinges 240, and are being supported above the ground by legs 260. A mattress 280 is housed within the region enclosed by face 210, face 220, and their corresponding flanks, flank 212, 214 (not shown), 222 and 224. Retainer belt 290 straps around mattress 280 and holds it to face 210. Once face 210 and face 220 have been opened, belt 290 can be released and mattress 280 can be unfolded. Mattress 280 has optional joint 285 which allows a one-piece mattress 280 to fold and unfold. A mattress having separable head and foot ends, of course, would omit the joint 285, and FIG. 2 should be interpreted as contemplating both a one-piece mattress and a mattress having separable head and foot ends. It is also contemplated that hook and loop or other fasteners can be used to assist in securing the head and foot ends of the mattress 280 with respect to one another.

Figure 3:
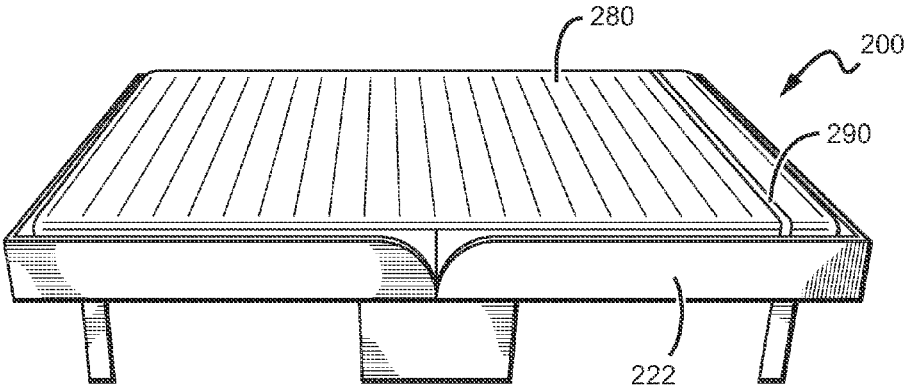
FIG. 3 is a side perspective view of the foldout cabinet bed of FIG. 2, where the mattress is unfolded to lie out upon both faces.

FIG. 3 is a side perspective view of the foldout cabinet bed of FIG. 2, where the mattress is unfolded to lie out upon both faces.

In FIG. 3, retainer 290 is shown as an elastic belt that stretches from flank 212 to opposing flank 214 (not shown), and tightly presses folded mattress 280 to face 210. However, retainer 290 could be any design or configuration for extracting mattress 280 from the interior space of base 230. In another embodiment, a hook and loop (Velcro®) strap is used to hold folded mattress 280 to face 210. Releasable fasteners are well known and one skilled in the art will recognize that various embodiments of fasteners can be used to hold folded mattress 280 to face 210.

Retainer 290 can have various different functions. One function is to pull a portion of the mattress 280 out of the interior space of base 230 when the cabinet is transitioning from a folded configuration to an open configuration. Retainer 290 can also prevent the mattress from falling into the interior space of base 230 when the cabinet is transitioning between open and folded configurations.

A suitable retainer could be located in any suitable position and orientation, as for example on face 220 rather than 210. For example, a retainer could be an elastic strap that stretches from the bottom end of face 210 to the bottom end of face 220, and passes underneath mattress 280. In this manner, the retainer would push mattress 280 out of the interior space of base 230 when the cabinet is transitioned from a folded configuration to an open configuration. In yet another embodiment, retainer could comprise a foot pedal and lever located beneath the mattress, which acts to push the mattress out of the interior space of base 230.

Figure 4A:
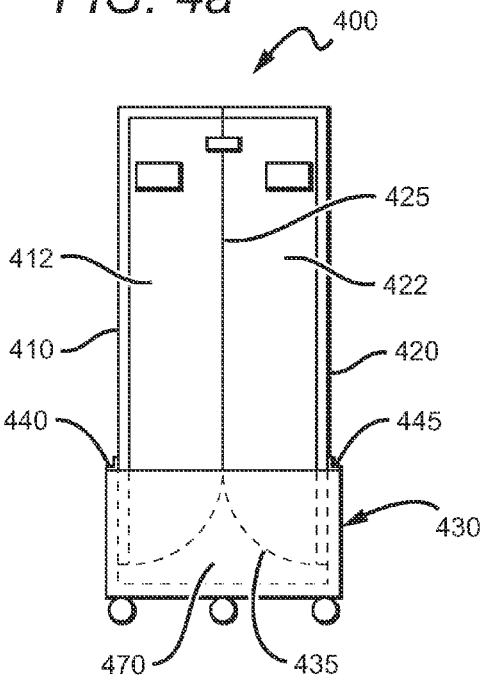
FIG. 4*a* is a side view of the foldout cabinet bed of FIG. 2, in a closed configuration.
Figure 4B:
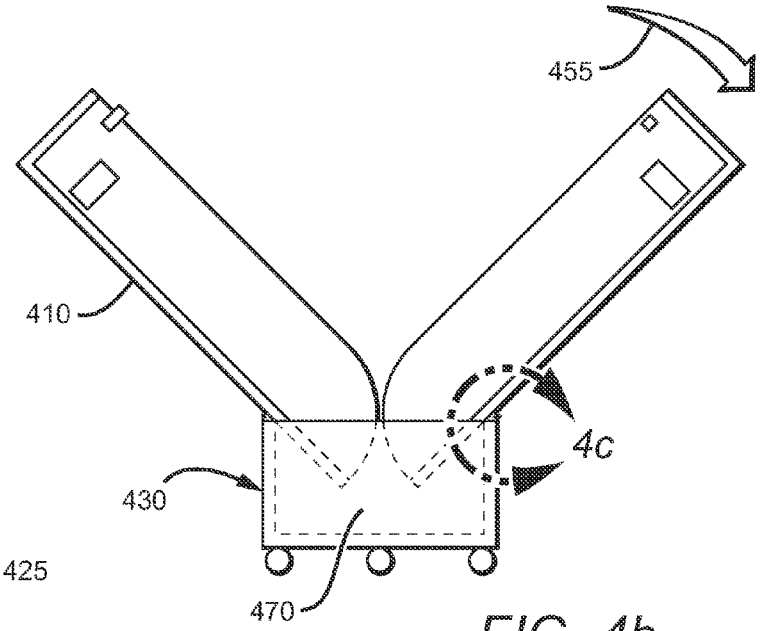
FIG. 4*b* is a side view of the faces of the foldout cabinet bed of FIG. 2, in a partially opened configuration.

FIG. 4*a* is a side view of a cabinet bed 400 in a folded configuration. Cabinet bed 400 has a first face 410, a second face 420, and a base 430. Each face has two flanks, face 410 having flank 412, and face 420 having flank 422. Abutment 425 is where the edges of flanks 412 and 422 meet. The bottom ends of flanks 412 and 422 are shaped with a curvature 435 which allows face 410 and 420 to open without pushing against each other. Curvature 435 also advantageously minimizes the number of exposed sharp points, providing a safer bed design. Base 430 defines an interior space 470. In the embodiment of FIG. 4*a*, face 410 and 420 rotate about base 430 via hinges 440 and 445, respectively. A folded mattress within the cabinet can be releasably attached to face 410 or 420 via a retainer (shown in FIG. 2), such that as face 410 and 420 are rotated open, the mattress is pulled out of interior space 470. The retainer also prevents the mattress from falling into interior space 470 when the cabinet is being closed. FIG. 4*b* shows the cabinet bed 400 in a partially open configuration. Arrow 455 in FIG. 4*b* shows rotation of face 420 about base 440. FIG. 4*c* shows a close-up of hinge 445, with screw holes 442 and pivot 444.

FIG. 5*a* shows a side view of cabinet 400 in a partially open configuration. Cabinet 400 has a removable leg 460, which supports face 420 above the ground when in a substantially horizontal disposition. Each of face 410 and 420 preferably has at least two legs for supporting the faces above ground when the cabinet bed is in the open configuration. FIG. 5*b* is a close-up of leg 460, showing how the end of leg 460 fits into bracket 465, which is attached to face 420. Leg 460 is preferably inserted into bracket 465 just before unfolding the faces 410 and 420. Bracket 465 is preferably designed to resemble a part of a cabinet such that it is "hidden" when cabinet bed 400 is closed. FIG. 5*a* also shows a catch 405 that holds face 410 in a substantially vertical position. Catch 405 advantageously prevents face 410 from falling down when face 420 is being repositioned from a substantially vertical to a substantially horizontal position.

Leg 460 can alternatively be integrated within the cabinet. For example, telescopic legs could be stored within the thickness of the walls of first and second faces. Such legs could be extended and locked in position when the bed is in an open configuration, and then retracted and hidden when the bed is in a folded configuration. In another embodiment, the legs could be hingeably attached to the exterior of the first and second faces 410 and 420, and then be pivoted out when the bed is in an open configuration. One of ordinary skill in the art will recognize that many other leg designs and configurations would be compatible with the inventive concepts taught herein.

Figure 6:
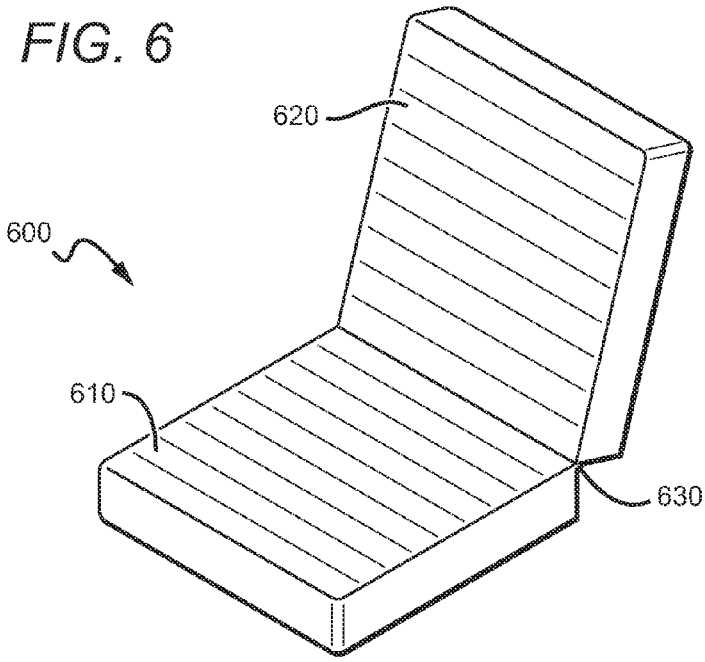
FIG. 6 is a perspective view of a mattress.

FIG. 6 shows a mattress 600 for use with cabinet bed 400. Mattress 600 has a head end 610, a foot end 620, and a connecting fabric 630. Fabric 630 connects the head and foot ends such that mattress 600 is regarded herein as a one-piece mattress. Fabric 630 also provides a flexible joint for folding foot end 620 onto head end 610.

Mattress 600 can be made of any material that provides a suitable surface area for sleeping or resting. Mattress materials are well known, and various designs and configurations have been utilized over the centuries. For example, cotton, foam (e.g., Tempur-Pedic™), springs, water, and air are all common mattress materials. Previous dual-opening foldout cabinet beds have failed to provide a simple cabinet design for housing a comfortable innerspring mattress. While all suitable mattress materials are contemplated, the cabinet beds taught herein advantageously utilize a simple cabinet design that is capable of functioning with an innerspring mattress.

Figure 7:
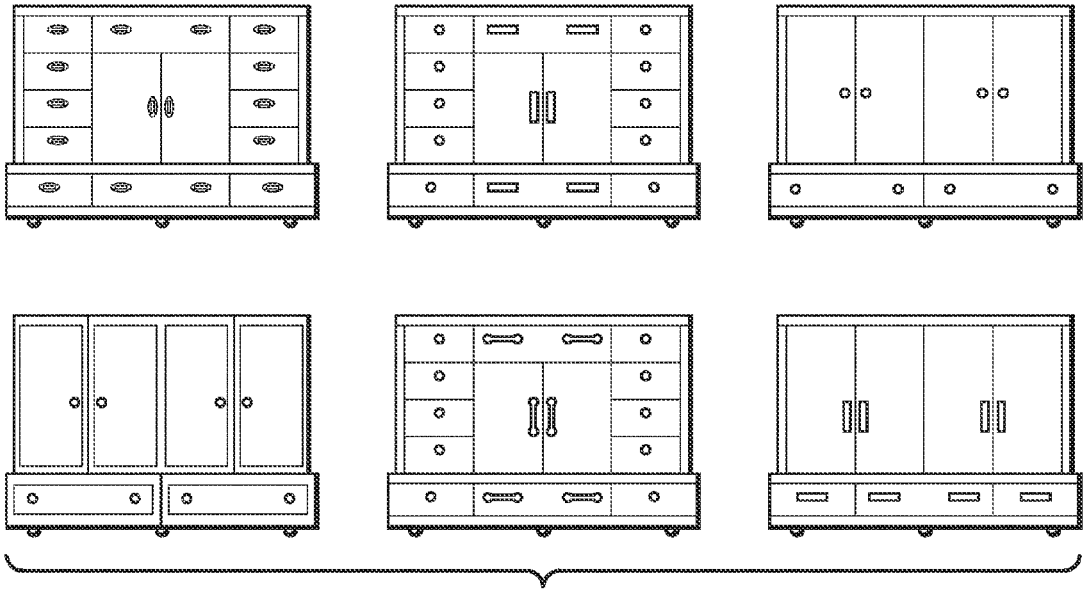
FIG. 7 shows six exterior designs for foldout cabinet beds.

FIG. 7 shows six different designs resembling a cabinet. The shape of the drawer handles, color of the cabinet, materials used, surface finish, number of drawers, and other various aspects of the cabinet bed can be configured to match a specific interior design or style.

Figure 8:
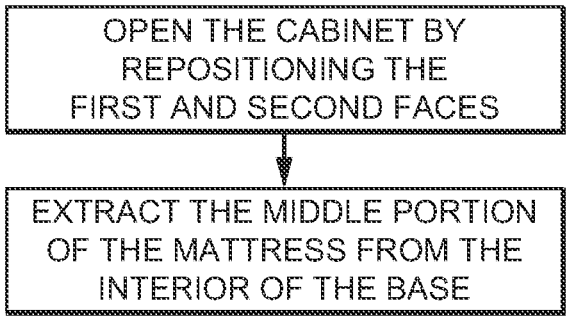
FIG. 8 is a schematic of a method of deploying a cabinet bed.

FIG. 8 shows a schematic of steps for a method of deploying a foldout cabinet bed. The method includes the steps of (i) opening the cabinet by repositioning the first and second faces of the cabinets, and (ii) extracting the middle portion of the mattress from the interior space of the cabinet's base. In embodiments where a rigid mattress occupies the interior space of the base, the step of extracting the mattress from the interior space is preferably performed before or simultaneously with the step of opening the cabinet.

The step of opening the cabinet can be performed by releasing a catch that holds the first and second faces together, and then manually pivoting the faces against the base. In this manner, the faces are pivoted from a substantially vertical position to a substantially horizontal position. The step of opening the cabinet could also be performed in an automated fashion by using a motor to unwind a cord that is connected to the first and second faces in such a manner that the faces are pivoted against the base and repositioned from a vertical disposition to a horizontal disposition. The motor could optionally be actuated via a wireless signal. It is further contemplated that the step of opening the cabinet could be performed by repositioning the faces either simultaneously or in two separate steps. A linkage similar to that in Koskul could be used to stabilize the faces as they fold and unfold simultaneously. In one embodiment, the method is performed by repositioning the first face and extracting the middle portion of the mattress out from the interior space simultaneously, and then repositioning the second face.

As used herein, the term "extracting" means removing or displacing. The step of extracting the middle portion of the mattress from the interior space of the base could be performed by fastening both ends of the folded mattress to a face with a retainer, such that when that face is repositioned from a vertical to a horizontal position the mattress is pulled out of the interior space. In this manner, the step of opening the cabinet and the step of extracting the middle portion of the mattress are performed simultaneously. The retainer could be an elastic belt, a hooks-and-loops strap (Velcro strap), or any other fastener suitable for releasably holding the folded mattress to one of the faces. The step of extracting the middle portion of the mattress could also be performed by stepping on a foot petal located underneath the base, causing the mattress to be pushed out of the interior space via a mechanical lever. In yet another embodiment, the retainer is an elastic cord stretching from the bottom end of the first face to the bottom end of the second face, causing the mattress to be pushed out of the interior space when the faces are repositioned from a vertical to a horizontal disposition. Various designs and configurations can be employed in order to perform the step of extracting the middle portion of the mattress from the interior portion of the base.

Figure 9:
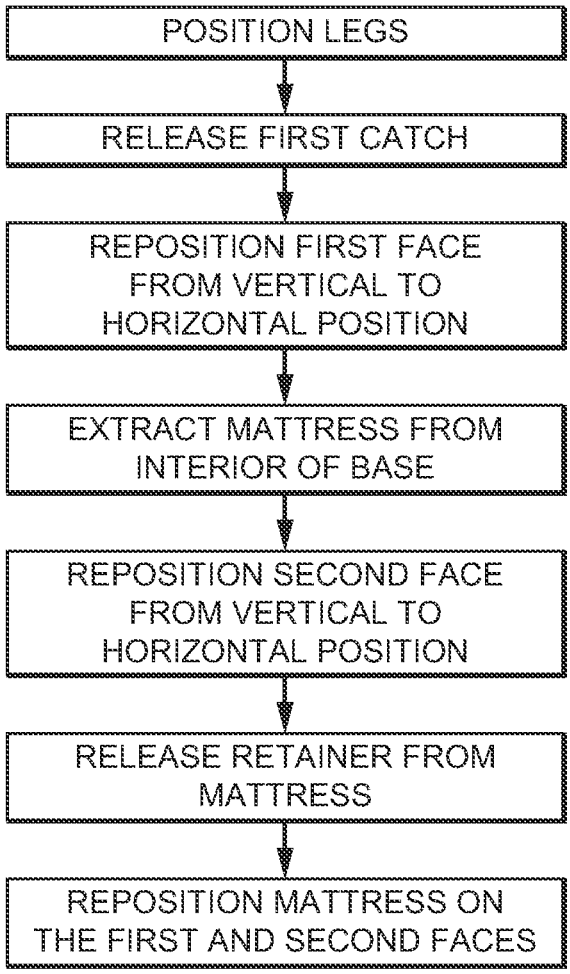
FIG. 9 is a schematic of a method of using a cabinet.

FIG. 9 shows a schematic of steps for a method of using a foldout cabinet bed. First, legs on the cabinet are positioned so that, when the first and second faces of the cabinet are opened, the legs support the faces above the ground. For example, this step could be performed by extending telescopic legs located within the cabinet, inserting legs into slots on the cabinet, or sending a wireless signal to controls within the cabinet that can position the legs via an actuator. Then, a first catch is released, allowing the first face of the cabinet to unfold. It is contemplated that the step of releasing a first catch could be performed before the step of positioning the legs. However, positioning the legs before releasing the first catch will ensure that the first face of the cabinet does not fall down while positioning the legs. It is further contemplated that the first catch could release the second face rather than the first face. It is not essential that the first face be unfolded first. It is also contemplated that the first catch could release both the first and second faces of the cabinet, allowing both to be unfolded simultaneously or in any desired order.

After the first catch is released, the first face is unfolded by repositioning the face from a vertical position to a horizontal position. Since the mattress is fastened to the first face, the step of extracting the mattress from the interior base is performed simultaneously with the step of repositioning the first face. Next, where a second catch is used to secure the second face in place while the first face is being unfolded, then the step of releasing the second catch can be performed (not shown). The second face of the cabinet can then be unfolded. The retainer holding the mattress to the first face is then released. In one embodiment, this step is performed by unhooking an elastic belt that stretches across opposite edges of the first face and around the folded mattress. It is also contemplated that the step of releasing the retainer could be performed before the step of repositioning the second face. Further, in embodiments where a second catch is not used to secure the second face, the steps of repositioning the first and second faces could be performed simultaneously. Finally, the mattress is unfolded.

While it is contemplated that various steps could be preformed automatically, in especially preferred embodiment the steps are all performed manually. In this manner, the structure of the foldout cabinet bed is advantageously simplified. It is further contemplated that the steps could be performed in reverse so as to retract or fold the cabinet bed.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . . and N, the text should be interpreted as requiring only one element from the group, not A plus N, or B plus N, etc.

What is claimed is:

1. A foldout bed transitionable between an open configuration and a folded configuration, the bed comprising:

a cabinet having first and second faces and a base having an interior space;

a safety catch that releasably maintains at least one of the faces in a substantially vertical position when the foldout bed is being transitioned to the open configuration;

wherein the first and second faces are rotatably coupled with the base such that an end of each of the first and second faces occupies a portion of the interior space when the cabinet is in the folded configuration;

wherein the first and second faces each have first and second slots for removably receiving an insertable leg;

a mattress having a head end and a foot end, and a connecting fabric that hingeably couples the head end with the foot end; and a retainer disposed to releasably hold both head and foot ends of the mattress to the first face when the first face is disposed in both open and folded configurations.

2. The bed of claim 1, wherein the head end and the foot end of the mattress are inner-spring mattresses.

3. The bed of claim 1, wherein the inner space is sized and dimensioned to receive the head end, foot end, and connecting fabric of the mattress when the foldout bed is in the folded configuration.

4. The bed of claim 1, wherein the base further comprising at least two wheels and wherein the base transfers weight from the first and second faces to the wheels.

5. The bed of claim 1, further comprising a first, second, third and forth removable leg for inserting into the first and second slots of the first and a second faces.

6. The bed of claim 1, further comprising a head board and a foot board that are rotated to collectively form a top of the foldout bed when the foldout bed is in the folded configuration.

7. The bed of claim 1, wherein the first and second slots of the first and second faces are each defined by a bracket coupled with one of the first and second faces.

* * * * *